US006388445B1

(12) United States Patent
Andersson

(10) Patent No.: US 6,388,445 B1
(45) Date of Patent: May 14, 2002

(54) CAPACITOR DISCHARGE ENGINE IGNITION SYSTEM WITH AUTOMATIC IGNITION ADVANCE/RETARD TIMING CONTROL

(75) Inventor: Martin N. Andersson, Caro, MI (US)

(73) Assignee: Walbro Corporation, Cass City, MI (US)

( * ) Notice: Subject to any disclaimer, the term of this patent is extended or adjusted under 35 U.S.C. 154(b) by 0 days.

(21) Appl. No.: 09/548,950

(22) Filed: Apr. 13, 2000

(51) Int. Cl.[7] ..... F02P 17/00
(52) U.S. Cl. ..... 324/380; 324/382
(58) Field of Search ..... 324/380, 381, 324/382, 388, 391, 536, 677, 678, 399; 123/198 DC

(56) References Cited

U.S. PATENT DOCUMENTS 5,025,498 A 6/1991 Agren
5,245,965 A 9/1993 Andersson
5,878,709 A * 3/1999 Andersson et al. ... 123/198 DC

* cited by examiner

*Primary Examiner*—Safet Metjahic
*Assistant Examiner*—J Kerveros

(74) *Attorney, Agent, or Firm*—Reising, Ethington, Barnes, Kisselle, Learman & McCulloch, P.C.

(57) ABSTRACT

A capacitor discharge engine ignition system that includes an ignition coil having a primary winding and a secondary winding for coupling to an engine ignition spark plug. A first electronic switch has primary current conducting electrodes in circuit with an ignition charge storage capacitor and the primary winding of the ignition coil, and a control electrode responsive to trigger signals for operatively connecting the ignition charge storage capacitor to discharge through the primary winding of the ignition coil. A charge/trigger coil arrangement generates periodic signals in synchronism with operation of the engine. The charge coil generates a charge signal to charge the ignition charge storage capacitor, while the trigger coil generates a trigger signal for triggering discharge of the capacitor through the ignition coil. An electronic circuit for controlling timing of the trigger signal as a function of engine speed includes a second electronic switch having primary current conducting electrodes operatively connected to the control electrode of the first electronic switch, and a control electrode. An RC circuit, including a resistor and a capacitor, is operatively connected to the charge coil and the control electrode of the second electronic switch to prevent application of the trigger signal to the control electrode of the first electronic switch during occurrence of the charge signal, and thereby controlling timing of application of the trigger signal to the control electrode of the first electronic switch as a function of engine speed.

6 Claims, 3 Drawing Sheets

CAPACITOR DISCHARGE ENGINE IGNITION SYSTEM WITH AUTOMATIC IGNITION ADVANCE/RETARD TIMING CONTROL

The present invention is directed to capacitor discharge engine ignition systems for small two and four stroke engines used in chain saw and weed trimmer applications, for example. The invention is more specifically directed to automatic control of engine ignition timing to obtain spark advance between starting and normal operating speeds, and to retard timing and thereby limit operation at excess engine operating speed.

BACKGROUND AND OBJECTS OF THE INVENTION

The time and occurrence of engine ignition is of importance to startability, output power and emissions performance of engines, including small two and four stroke engines. Optimum engine ignition timing varies, primarily as a function of engine speed and engine load. Secondary factors, such as emissions performance and fuel quality, also play a role in determining optimum spark timing. Mechanical and microprocessor-based electronic timing control systems have been proposed for large engine applications, such as automotive engines, but are not well suited to small engine applications because of cost and packaging factors. Specifically, it has been proposed to employ microprocessor-based ignition modules in small engine applications, in which desired advance and/or retard timing characteristics are programmed into the microprocessor. However, cost factors associated with microprocessor-based modules are prohibitive in most small engine applications.

It has also been recognized that there is a danger to the integrity of the engine at excess operating speed. It is possible for the engine, particularly when there is either no load or a load that has been suddenly removed, to accelerate to an rpm range at which the engine components can be damaged. Carburetor ball-type speed governors are conventionally employed, having a spring-loaded ball that is sensitive to engine vibration. The level of vibration is, in turn, sensitive to engine speed. When vibration-induced forces on the ball overcome spring pressure, fuel is added to the engine. This sudden enrichment of the air/fuel ratio slows the engine, but produces increased emissions from the engine exhaust. Electronic systems have been proposed for disabling ignition in the event of excess engine speed, as disclosed for example in U.S. Pat. No. 5,245,965. However, every missed spark represents a charge of air and fuel that is not burned in the engine. This unburned fuel exits the engine and enters the exhaust system. The unburned fuel and air leave the exhaust system as unburned hydrocarbon emissions, causing an increase in air pollution. The spark suppression technique also causes mis-operation of the engine, increasing engine vibration and potentially suggesting malfunction of the engine to a user. Both the ball speed governor and the electronic skip spark governor result in unburned fuel and air entering the exhaust system. In catalytic converter- equipped engines, this fuel is oxidized catalytically in the converter, which increases the temperature of the converter. Converter technology in small engine applications is limited in size and allowable percentage of effectiveness, so that any fuel oxidation can greatly reduce effectiveness of the catalytic process.

It is an object of the present invention to provide a capacitor discharge ignition system that is particularly well suited for small engine applications, which eliminates kick-back during starting, which facilitates manual starting of the engine, which includes facility for automatically preventing over-speed operation of the engine while reducing delivery of unburned fuel to the exhaust system, which is relatively inexpensive, and/or which is well adapted for use in small two stroke and four stroke engine applications.

SUMMARY OF THE INVENTION

A capacitor discharge engine ignition system in accordance with a presently preferred embodiment of the invention includes an ignition coil having a primary winding and a secondary winding for coupling to an engine ignition spark plug. A first electronic switch has primary current conducting electrodes in circuit with an ignition charge storage capacitor and the primary winding of the ignition coil, and a control electrode responsive to trigger signals for operatively connecting the ignition charge storage capacitor to discharge through the primary winding of the ignition coil. A charge/trigger coil arrangement generates periodic signals in synchronism with operation of the engine. The charge coil generates a charge signal to charge the ignition charge storage capacitor, while the trigger coil generates a trigger signal for triggering discharge of the capacitor through the ignition coil. An electronic circuit for controlling timing of the trigger signal as a function of engine speed includes a second electronic switch having primary current conducting electrodes operatively connected to the control electrode of the first electronic switch, and a control electrode. An RC circuit, including a resistor and a capacitor, is operatively connected to the charge coil and the control electrode of the second electronic switch to prevent application of the trigger signal to the control electrode of the first electronic switch during occurrence of the charge signal, and thereby controlling timing of application of the trigger signal to the control electrode of the first electronic switch as a function of engine speed.

The electronic circuit for controlling timing of the trigger signal as a function of engine speed in the preferred embodiment of the invention obtains both automatic spark advance between engine starting and normal operating speed, and engine ignition retard at excess engine operating speed. The charge coil and the trigger coil are constructed and arranged such that a trigger signal is generated in the trigger coil both before and after each charge signal is generated in the charge coil, but the charge on the capacitor of the RC engine timing circuit prevents application of the second trigger signal to the control electrode of the first switch, so that the charge on the ignition's charge storage capacitor is held until occurrence of the next trigger signal series. Timing of the leading trigger signal in the next series automatically advances as a function of increasing engine speed, so as to obtain an automatic spark advance with increasing engine speed between starting and normal operating speed. This automatic advance varies approximately linearly to a maximum advance in the range of 20° to 40°. In the event of excess engine speed, the charge on the capacitor of the RC ignition timing circuit does not have an opportunity fully to discharge, so that engine ignition is automatically retarded. However, ignition is not prevented, so unburned fuel is not fed to the engine exhaust system. Furthermore, engine ignition is prevented in the event of reverse engine operation.

BRIEF DESCRIPTION OF THE DRAWINGS

The invention, together with additional objects, features and advantages thereof, will be best understood from the following description, the appended claims and the accompanying drawings in which:

DETAILED DESCRIPTION OF PREFERRED EMBODIMENTS

Figure 1:
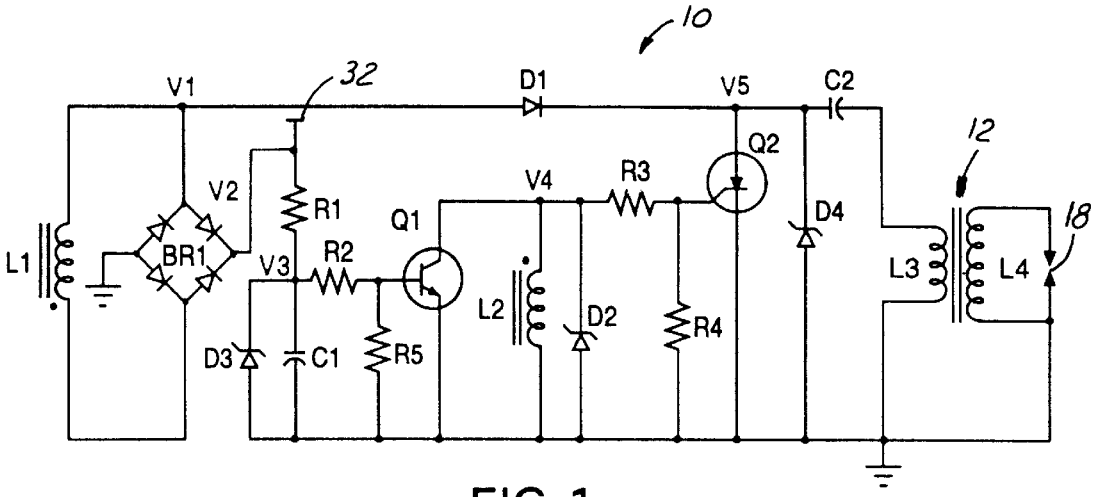
FIG. 1 is an electrical schematic diagram of a capacitor discharge engine ignition system in accordance with a presently preferred embodiment of the invention.
Figure 2:
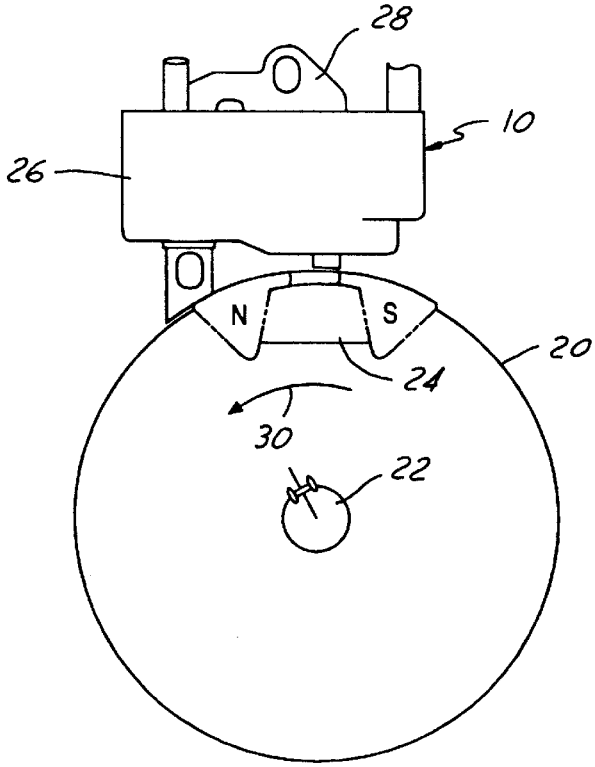
FIG. 2 is a schematic illustration of the ignition system of FIG. 1 disposed adjacent to an engine flywheel.

FIGS. 1–2 illustrate a capacitor discharge engine ignition system 10 in accordance with a presently preferred embodiment of the invention as comprising an ignition coil 12 having a primary winding L3 and a secondary winding L4 coupled to a spark plug 18 for initiating ignition at an engine. A flywheel 20 is suitably coupled to the engine crankshaft 22, and carries at least one magnet 24 that rotates in synchronism with engine operation. Ignition system 10 is in the form of a module 26 mounted on a U-shaped laminated stator core 28 having a pair of legs that terminate adjacent to the periphery of flywheel 20 as it rotates in direction 30.

Ignition system 10 includes a charge coil L1 that has one end connected in series through a diode D1, an ignition charge storage capacitor C2 and primary winding L3 of coil 12. The opposing end of coil L1 is connected to electrical ground through one diode of a diode bridge BR1. A trigger coil L2 is operatively connected to the gate of an SCR Q2. The primary current conducting anode and cathode electrodes of SCR Q2 are connected to capacitor C2 and electrical ground across the series combination of capacitor C2 and primary winding L3. A zener diode D4 is reverse-connected across the anode/cathode electrodes of SCR Q2.

Charge coil L1 is connected through diode bridge BR1 and through a resistor R1 to the junction of a capacitor C1 and a resistor R2. Resistor R2 and a resistor R5 are connected in series across capacitor C1, with the combination of capacitor C1 and resistors R2, R5 forming an RC network to control operation of a transistor Q1. A zener diode D3 is reverse-connected across capacitor C1. Transistor Q1 has a control electrode or base connected to the junction of resistors R2, R5 and primary current conducting electrodes (collector and emitter) connected across trigger coil L2. A zener diode D2 is reverse-connected across trigger coil L2. A voltage divider, comprising a resistor R3 and a resistor R4, is connected in series across diode D2, with the junction of resistors R3, R4 being connected to the gate or control electrode of SCR Q2. A kill switch terminal 32 is connected to the junction of bridge BR1 and resistor R1 for termination of operation of the ignition circuit in the event of activation by an operator.

Figure 3A:
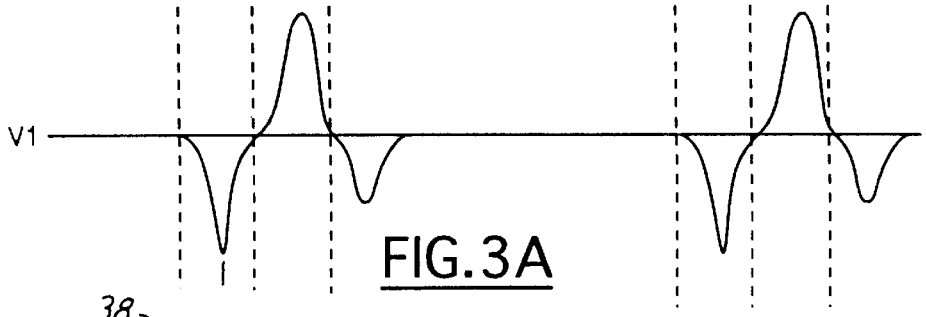
FIGS. 3A–3B, 4A–4C, 5A–5B, 6A–6B and 7 are signal timing diagrams useful in explaining operation of the embodiment of the invention illustrated in FIGS. 1 and 2.
Figure 3B:
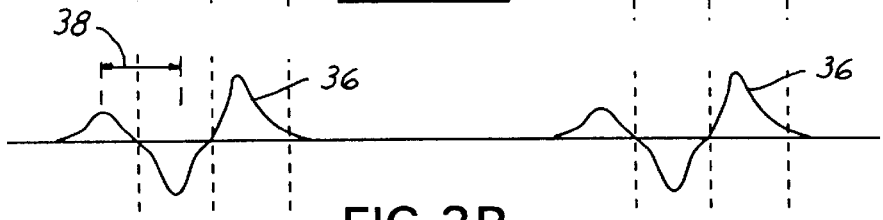

FIGS. 3A and 3B illustrate the waveforms of the charge signal V1 (FIGS. 1 and 3) and trigger signal generated in coils L1 and L2 respectively during two cycles of operation—i.e., two revolutions of flywheel 20 (FIG. 2). The charge signal V1 generated in charge coil L1 has a positive peak separating two negative peaks. The trigger signal 36 generated in trigger coil L2 has two positive peaks separated by a negative peak. Trigger coil L2 and charge coil L1 are preferably wound around separate legs of ignition core 28 (FIG. 2) to obtain a phase separation 38 (FIG. 3B) between the trigger and charge signals, preferably on the order of 50°.

Figure 4A:
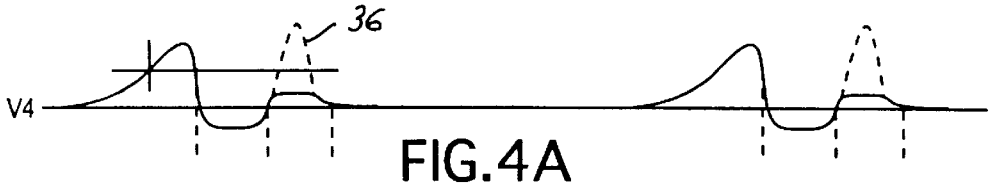
Figure 4B:
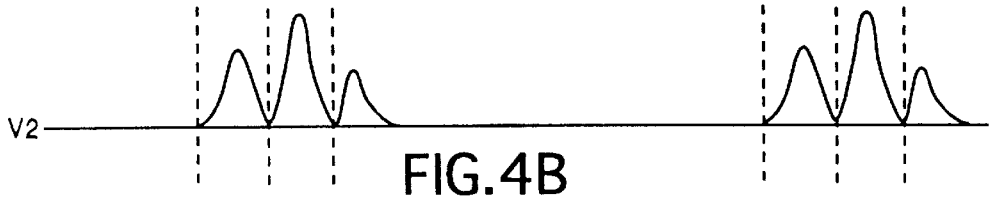
Figure 4C:
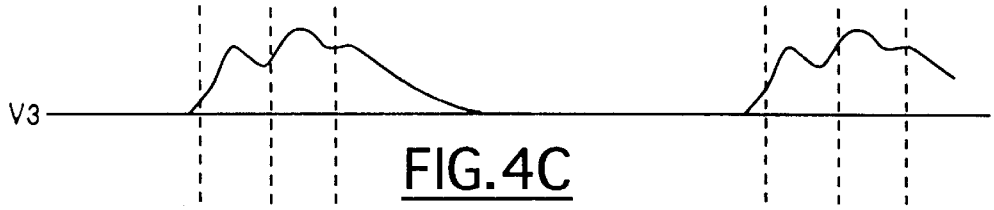
Figure 5A:
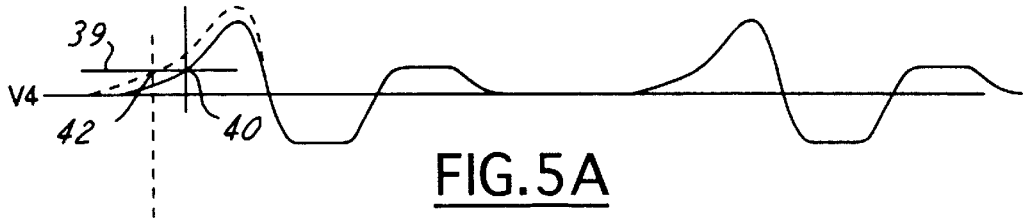
Figure 5B:
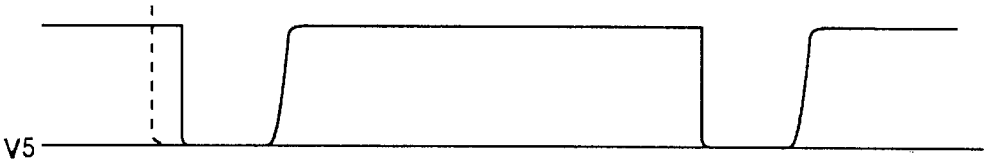

Referring to FIGS. 4A–4C, the signal V1 generated by charge coil L1 is full-wave rectified by bridge BR1 to provide a rectified signal V2 (FIGS. 1 and 4B). This rectified signal is applied through resistor R1 to capacitor C1 to provide a control voltage V3 illustrated in FIG. 4C. The positive voltage on capacitor C1 functions through resistors R2, R5 to close transistor switch Q1 during the second positive cycle of the trigger signal (compare signal 36 in FIG. 3B with signal V4 in FIG. 4A), thus preventing closure of SCR Q2 during charging of ignition charge storage capacitor C2. This suppression of the second positive trigger pulse by transistor Q1 alters the leading edge of the next succeeding trigger pulse that appears on the next cycle of operation, as shown in FIG. 5A. The amplitude of the leading trigger signal pulse increases as a function of engine speed. Thus, the time at which the trigger signal voltage applied through resistors R3, R4 to the gate of SCR Q2 (FIG. 1) exceeds the SCR gate trigger level 39 advances with increasing engine speed. Thus, in FIGS. 5A and 5B, ignition occurs at time 40 at low engine speed, and advances to time 42 at higher engine speed. FIG. 5B illustrates the voltage V5 across capacitor C2 (FIG. 1). The speed-dependent waveform of FIG. 5A thus creates the timing advance feature of the present invention.

Figure 6A:
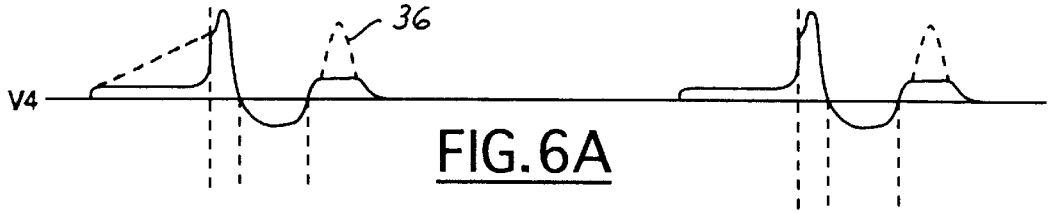
Figure 6B:
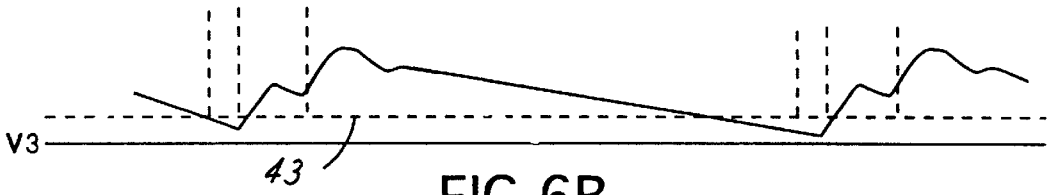
Figure 7:
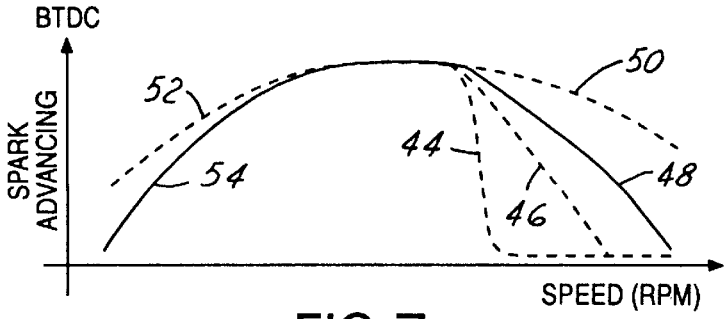

High speed operation is illustrated in FIGS. 6A and 6B. At high engine speed, capacitor C1 does not have time fully to discharge through resistors R2, R5 between operating cycles. R2, R5 control voltage V3 across capacitor C1 continues to close transistor Q1 during the beginning of the trigger pulse V4 of the next operating cycle, thus delaying or retarding the spark ignition signal. When transistor Q1 finally shuts off(i.e., control voltage V3 decays below the threshold 43 of transistor switch Q1), the trigger pulse V4 is allowed to increase in voltage to initiate an ignition operation. FIG. 7 illustrates spark advance as a function of engine speed from low speed through normal operating speed to spark retard at excess operating speed. Changing the type or parameters of transistor Q1 controls the rate of change and amount of timing retard that can be gained at high engine speeds, as shown by the curve portions 44, 46, 48 and 50 in FIG. 7. In addition, the design and characteristics of transistor Q1 and SCR Q2 provides temperature stability to the design. SCR Q2 moves the ignition firing point earlier as a function of an increase in temperature, while transistor Q1 causes a delay of the ignition point with an increase in temperature. The net effect is that they together reduce or eliminate any change in firing time of the ignition module as a function of temperature. The ration between resistors R3 and R4 in FIG. 1 can be varied to obtain differing advance characteristics, as at 52, 54 in FIG. 7.

There has thus been provided a capacitor discharge engine ignition system that fully satisfies all of the objects and aims previously set forth. Automatic spark advance reduces or eliminates kick-back on initial starting, and generally facilitates starting of the engine. Automatic timing retard at excess engine speed reduces engine over-speed, while at the same time reducing or preventing discharge of unburned fuel into the exhaust system. The system of the present invention can be implemented employing low-cost analog components, and is usable on either two stroke or four stroke engines. A number of modifications and variations have been suggested. Other modifications and variations will readily suggest themselves to persons of ordinary skill in the art. The invention is intended to embrace all such modifications and variations as fall within the spirit and broad scope of the appended claims.

What is claimed is:

1. A capacitor discharge engine ignition system that includes:

ignition coil means having a primary winding and a secondary winding for coupling to engine ignition means, an ignition charge storage capacitor coupled to said primary winding, first electronic switch means having primary current conducting electrodes in circuit with said ignition charge storage capacitor and said primary winding, and a control electrode responsive to trigger signals for operatively connecting said ignition charge storage capacitor to discharge through said primary winding, charge/trigger coil means for generating periodic signals in synchronism with operation of the engine, including a charge coil for generating a charge signal to charge said ignition charge storage capacitor, and a trigger coil for generating said trigger signal to discharge said charge storage capacitor through said first switch means and said primary winding, and means for controlling timing of said trigger signal as a function of engine speed comprising second electronic switch means having a control electrode and primary current conducting electrodes operatively connected to said control electrode of said first electronic switch means, and an RC circuit, including a resistor and a second capacitor, operatively connecting said charge coil to said control electrode of said second electronic switch means, in parallel with said charge storage capacitor, to prevent application of said trigger signal to said control electrode of said first electronic switch means during occurrence of said charge signal and thereby control timing of application of said trigger signal to said control electrode of said first electronic switch means as a function of engine speed.

2. The system set forth in claim 1 wherein said means for controlling timing of said trigger signal comprises means for advancing timing of said trigger signal as a function of increasing engine speed, wherein suppression of said trigger signal during occurrence of said charge signal automatically advances occurrence of said trigger signal following occurrence of said charge signal.

3. The system set forth in claim 2 wherein said means for controlling timing of said trigger signal further comprises means for retarding timing of said trigger signal at excess engine speed, at which charge signal energy stored on said second capacitor functions through said second electronic switch means to retard application of said trigger signal to said control electrode of said first electronic switch means.

4. The system set forth in claim 1 wherein said means for controlling timing of said trigger signal comprises means for retarding timing of said trigger signal at excess engine speed, at which charge signal energy stored on said second capacitor functions through said second electronic switch means to retard application of said trigger signal to said control electrode of said first electronic switch means.

5. The system set forth in claim 1 wherein said charge/trigger coil means is constructed and arranged to generate one of said charge signals and two of said trigger signals leading and trailing said charge signal upon each operating cycle of the engine, and wherein said means for controlling timing is responsive to said charge signal for suppressing said second trigger signal.

6. The system set forth in claim 5 wherein said charge/trigger coil means comprises separate charge and trigger coils disposed on separate legs of a ferromagnetic core, such that said trigger signal leads said charge signal.

* * * * *